United States Patent [19]

Etherington

[11] Patent Number: 5,020,177

[45] Date of Patent: Jun. 4, 1991

[54] SHEET BEDDING CONSTRUCTION

[76] Inventor: Suzanne M. Etherington, 2 Bannockburn Avenue, St. Andrews, New South Wales 2566, Australia

[21] Appl. No.: 319,405

[22] Filed: Mar. 6, 1989

[30] Foreign Application Priority Data

Mar. 10, 1988 [AU] Australia ..... PI7179

[51] Int. Cl.[5] ..... A47G 9/02

[52] U.S. Cl. ..... 5/496; 5/497; 5/502

[58] Field of Search ..... 5/497, 496, 500, 502, 5/495, 482; 297/219

[56] References Cited

U.S. PATENT DOCUMENTS

| | | | |
|---|---|---|---|
| 1,530,088 | 3/1925 | Nathman | 297/219 |
| 1,771,872 | 7/1930 | Brock et al. | 5/496 |
| 2,161,448 | 6/1939 | Bishop | 297/219 |
| 3,295,277 | 1/1967 | Danielson | 150/52 |
| 3,832,743 | 9/1974 | Smith | 5/496 |
| 3,857,124 | 12/1974 | Hadley | 5/496 |
| 3,958,286 | 5/1976 | Rodinsky | 5/483 |
| 3,996,633 | 12/1976 | Burke | 5/497 |
| 4,035,854 | 7/1977 | Pardee | 5/497 |
| 4,495,233 | 1/1985 | Bassetti | 5/497 |
| 4,615,061 | 10/1986 | Scott | 5/497 |
| 4,642,826 | 2/1987 | Bassetti | 5/497 |
| 4,727,608 | 3/1988 | Joyce | 5/497 |

FOREIGN PATENT DOCUMENTS 0116992 8/1984 European Pat. Off. .

*Primary Examiner*—Alexander Grosz
*Attorney, Agent, or Firm*—Ladas & Parry

[57] ABSTRACT

The present invention discloses a fitted lower sheet having an elastic draw string which can be adjusted in length so that the fitted sheet can be located on any mattress within a range of nominal mattress sizes. A two part fastener located one part in the fitted lower sheet and one part in an upper covering is also disclosed to permit the upper covering to be releasably secured to the lower sheet. The upper covering can be either an upper sheet or quilt cover. The case of two fasteners and both a releasably secured upper sheet and quilt cover is also disclosed.

29 Claims, 8 Drawing Sheets

SHEET BEDDING CONSTRUCTION

Figure 1:
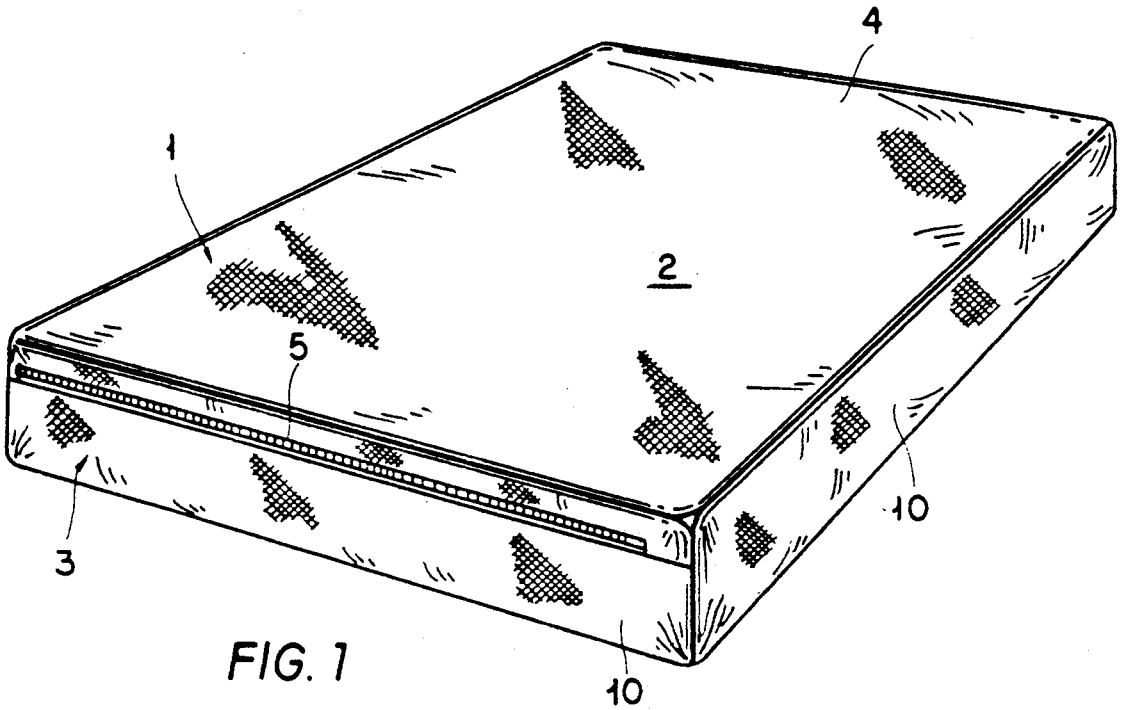

The present invention relates to bedding and, in particular, to the arrangement of bed sheets.

The traditional form of bed sheets is to have an upper and lower sheet which are both formed from rectangular pieces of fabric and which are secured to a mattress by being tucked underneath the mattress. This arrangment suffers from several disadvantages including in that the lower sheet tends to become partially dislodged and rumpled by the movement of the occupant(s) of the bed and thereby no longer represents a smooth and comfortable sleeping surface. Similarly, the upper sheet and any blankets, quilts or the like which provide further layers of covering also tend to become dislodged from the original made condition of the bed.

In order to overcome these problems it is known to provide a fitted sheet which is shaped to the shape of the mattress. Such fitted sheets take the form of a central generally rectangular area having a side wall which extends around the central area. The slide wall has a free edge which is that edge of the side wall remote from the central area.

It is known to provide various means of holding the fitted sheet onto the mattress. One means is to sew a strip of elastic either entirely around the free edge of the side wall, or only at the four corners of the free edge of the side wall. U.S. Pat. Nos. 4,703,530 (Gusman) 2,963,715 (Young) and 3,273,175 and 3,438,068 (both Anderson) are representative of this art. This arrangement works reasonably wll where there is a good fit in size between the fitted sheet and the mattress. However, the method is to some extent dependent upon the degree of extension of the elastic at the time it was sewn onto the sheet material. This is very dependent upon operator attention and consistent results are difficult to produce.

Furthermore, there are a large number of different mattress sizes, even within a nominal range such as a single bed. As a result, this prior art arrangement does not enable one size fitted sheet to be used for most, or substantially all, mattresses which are nominal size such as a single bed.

It is known to attempt to overcome this problem by the provision of stretch material woven from elastic thread for some or all of the side wall of the fitted sheet. U.S. Pat. Nos. 2,942,280 (May) and 3,020,566 (Anderson) are illustrative of this type of prior art.

Other arrangements have been proposed at various times in order to overcome various problems associated with fitted sheets. One variation of fitted sheets has the side wall formed as four separate flaps which are releasably joined together to form the corners of the fitted sheet. U.S. Pat. No. 4,461,049 (Hammond) is illustrative of this prior art. Another prior art arrangement is U.S. Pat. No. 4,495,233 (Bascetti) which discloses a flat sheet with four releasable pull cords of fixed length which are used to draw the flat sheet into the correct shape for a fitted sheet.

One problem with such fitted sheets is that they do not work well where the mattress is very short and without a firm frame. Mattresses formed entirely from sponge rubber present a particular problem because the corners of the mattress tend to curl up if the elastic tensioning is too tight with the result that the lower fitted sheet is dislodged. Conversely, if the elastic is too loose the fitted sheet will be dislodged from any mattress.

In recent years, waterbeds have gained increasing market acceptance over conventional beds having conventional mattresses. One disadvantage of the waterbed is that the water filled mattress is extremely heavy and it is therefore difficult to tuck in a conventional lower sheet. In addition, those fitted sheets which require adjustment each time they are fitted to the mattress, are also difficult to use in relation to waterbed mattresses.

The problems of upper sheets have been considered in U.S. Pat. Nos. 2,662,234 (Citron), 2,799,870 (Sullivan), 4,035,854 (Pardee) and 4,384,380 (Glaha). In these arrangements the lower sheet and upper sheet are permanently secured together to assist in bed making. However, these arrangements increase the difficulty in both washing and drying the joined sheets. Futhermore, as the lower sheet tends to wear more rapidly, both sheets must be discarded when the lower one wears out instead of only a single lower sheet being purchased.

The problem with upper sheets has also been considered in U.S. Pat. No. 3,832,743 (Smith) which discloses an arrangement in which an upper sheet and lower sheet can be releasably secured together at the foot of the bed so as to enable the bed to be made by pulling the upper sheet towards the head of the bed so that it quickly regains its intended position. However, the arrangement disclosed in this specification suffers from the disadvantages that a special flap must be provided in order to cover the fastener so that the feet of the sleeper do not come into contact with the fastener. This is a particular problem for those persons who sleep on their stomach with their toes extending vertically beyond the foot of the bed.

The present invention seeks to substantially overcome or ameliorate the abovementioned disadvantages by the provision of a bed sheet arrangement having a fitted lower sheet which is adjustable so as to fit a number of mattress sizes within a given nominal range. Furthermore, th adjustment need only be made once and thereafter the fitted sheet can be taken from the mattress for washing, and returned to the mattress when the bed is re-made with a minimum of effort.

A preferred feature of the present invention is the provision of two upper coverings each of which is able to be independently releasably secured to the foot of the bed.

In accordance with the present invention there is disclosed a bed sheet arrangement comprising a fitted lower sheet having a substantially rectangular central area having a foot end and a head end with a side wall extending around the the central area, that edge of said side wall remote from said central area being provided with an elastically extendable draw string which is constrained to said side wall edge, and at least a portion of said draw string being manually accessible.

Figure 2:
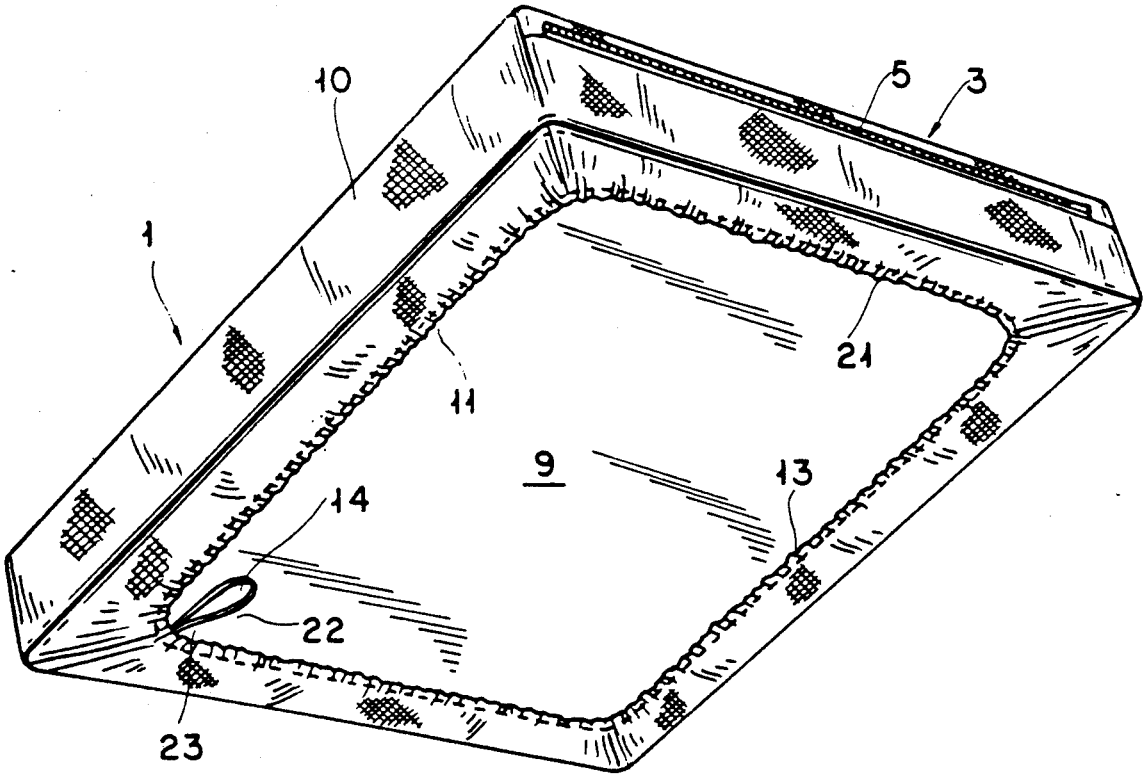
Figure 10:
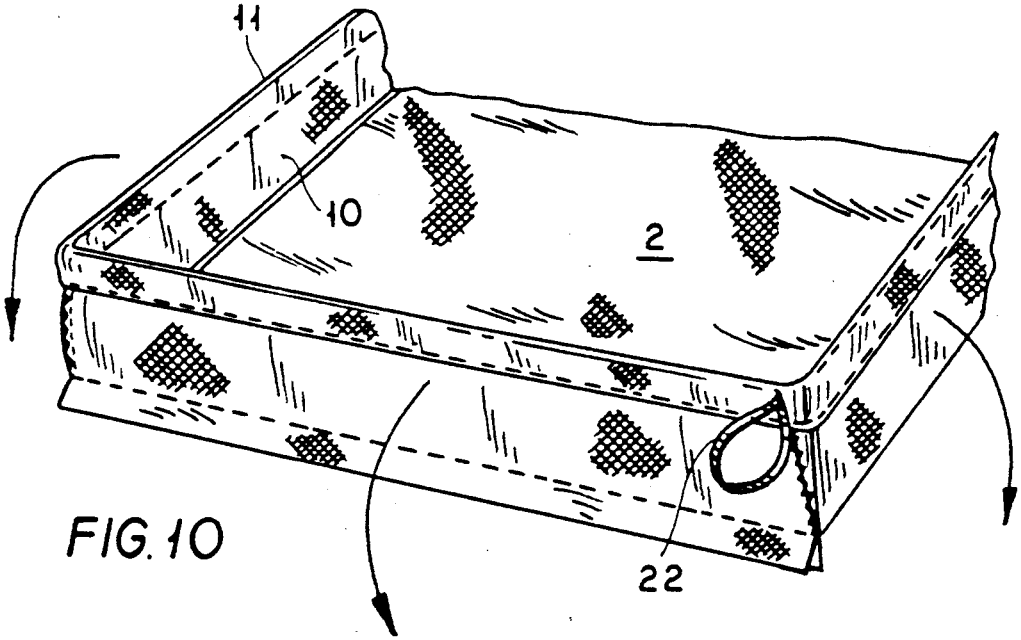
Figure 11:
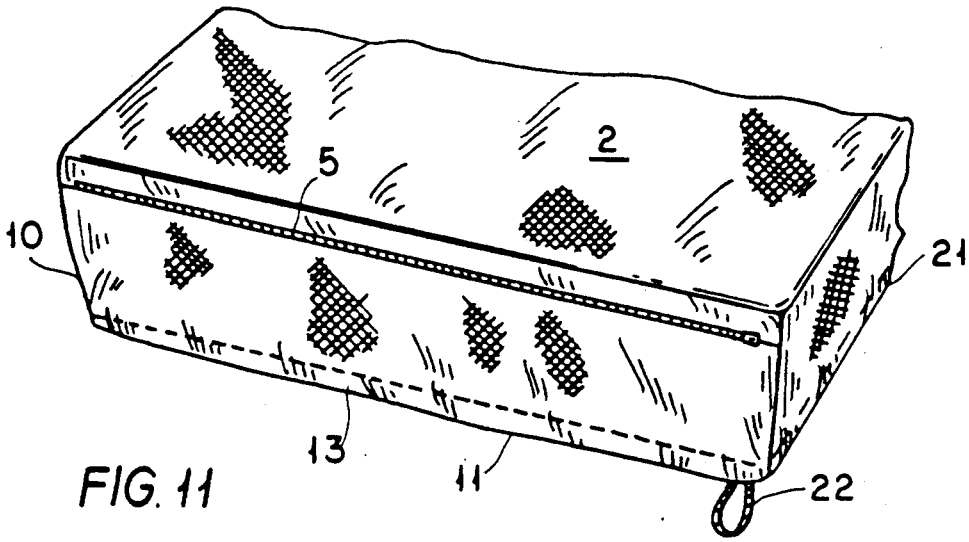
Figure 12:
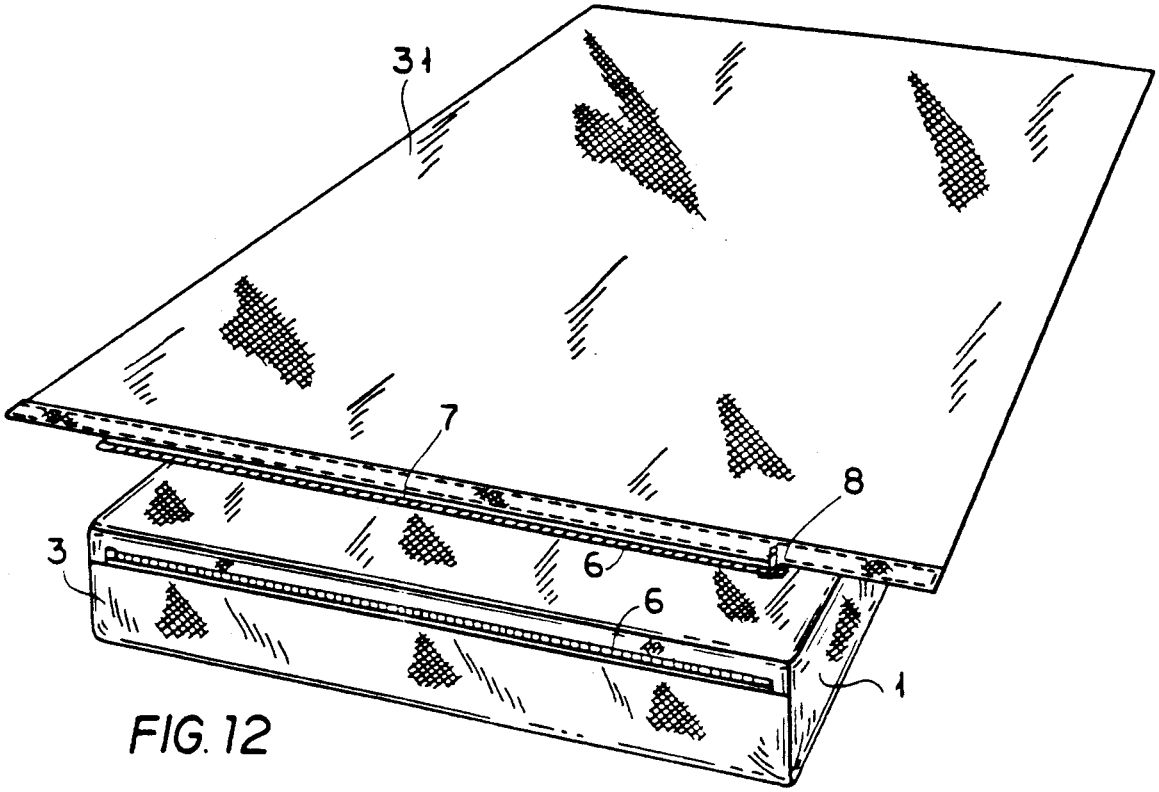
Figure 13:
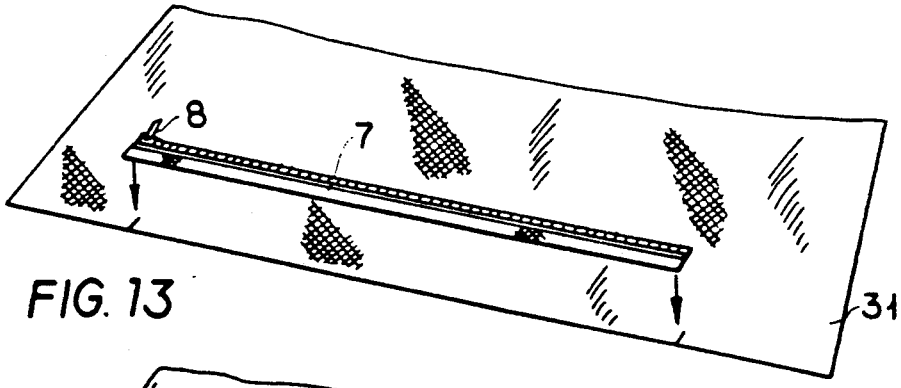
Figure 14:
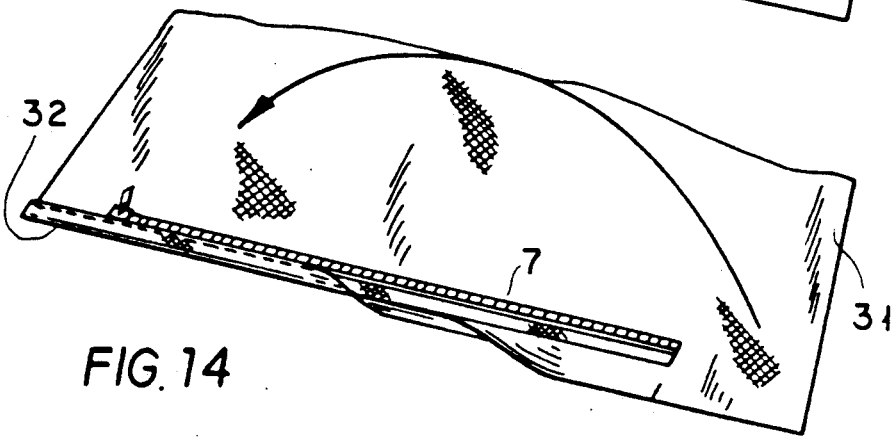
Figure 15:
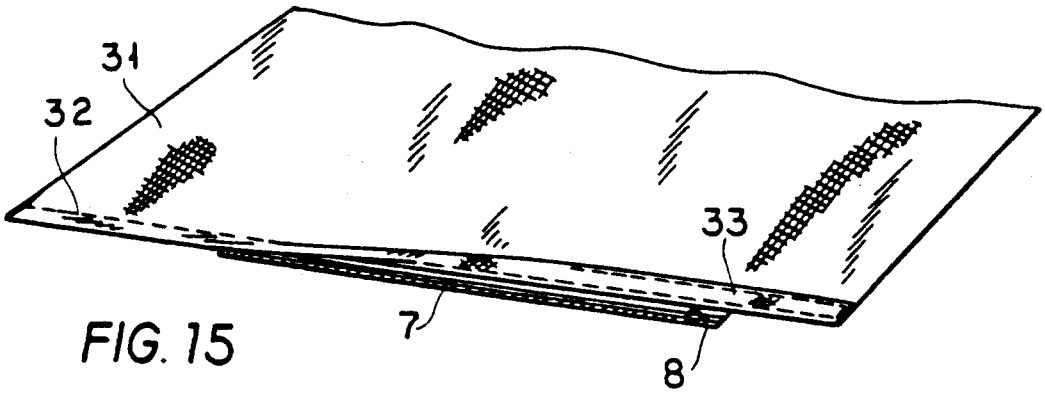
Figure 16:
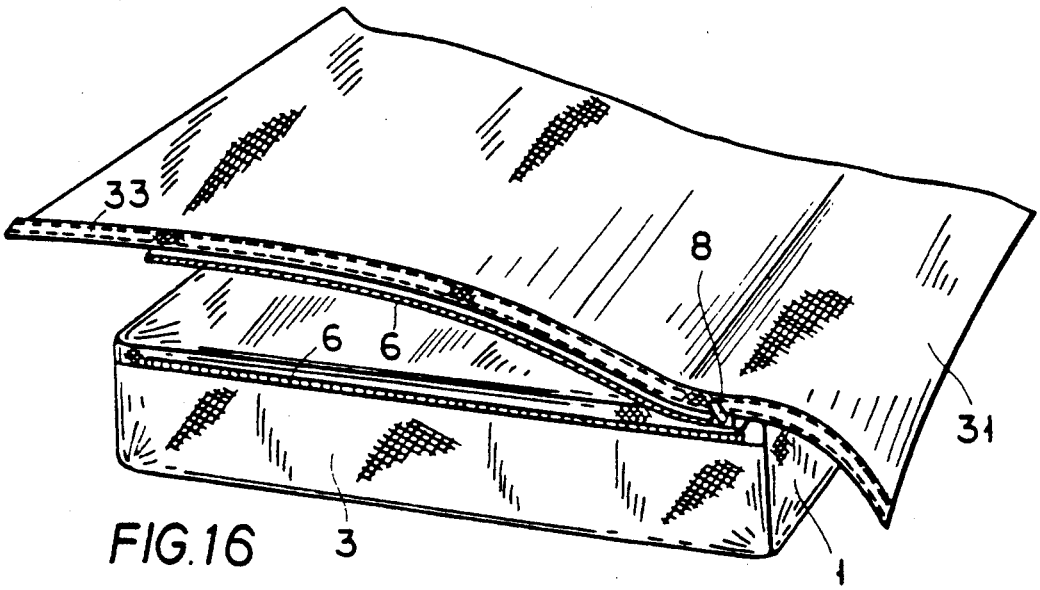
Figure 17:
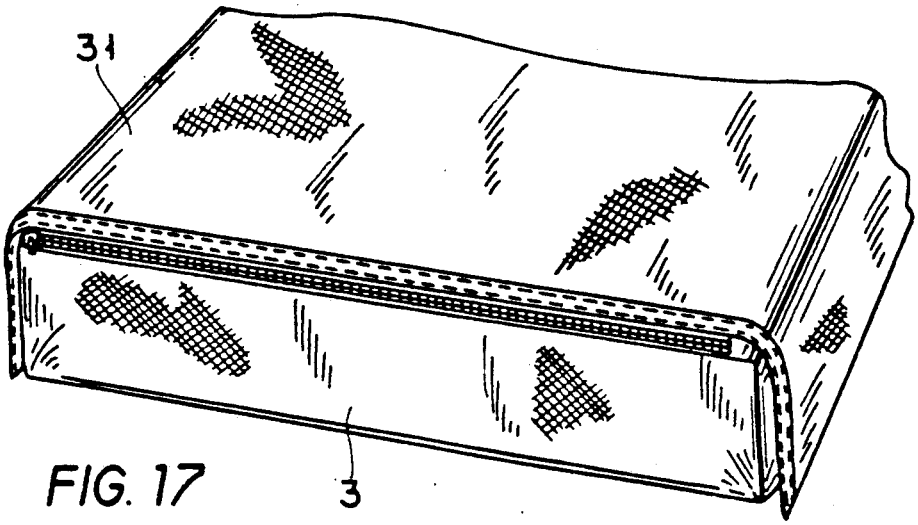
Figure 18:
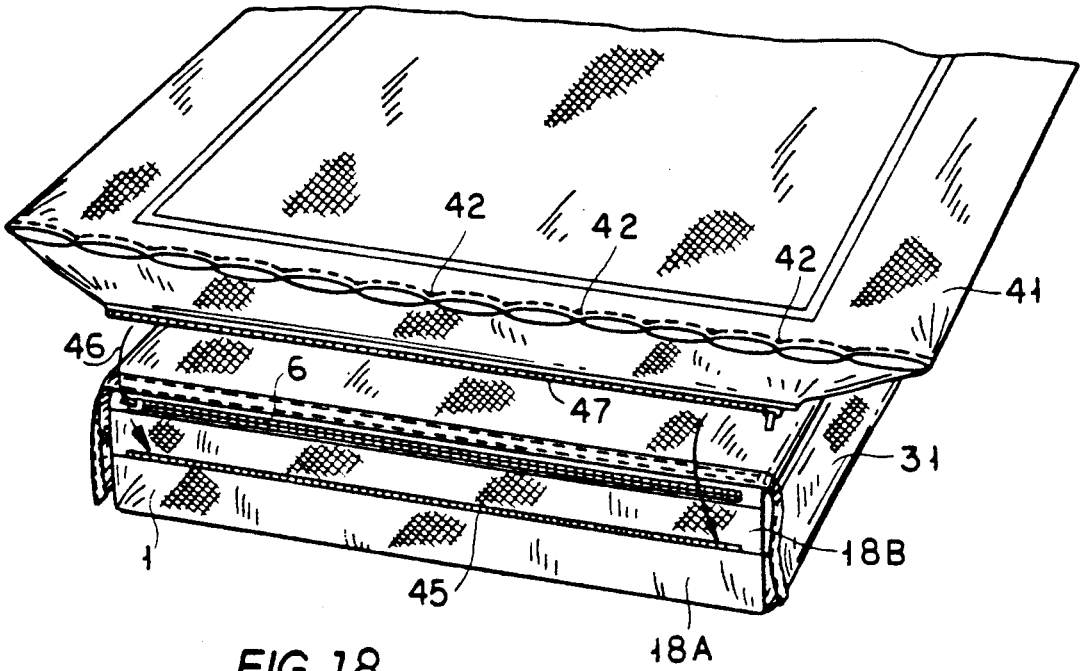
Figure 19:
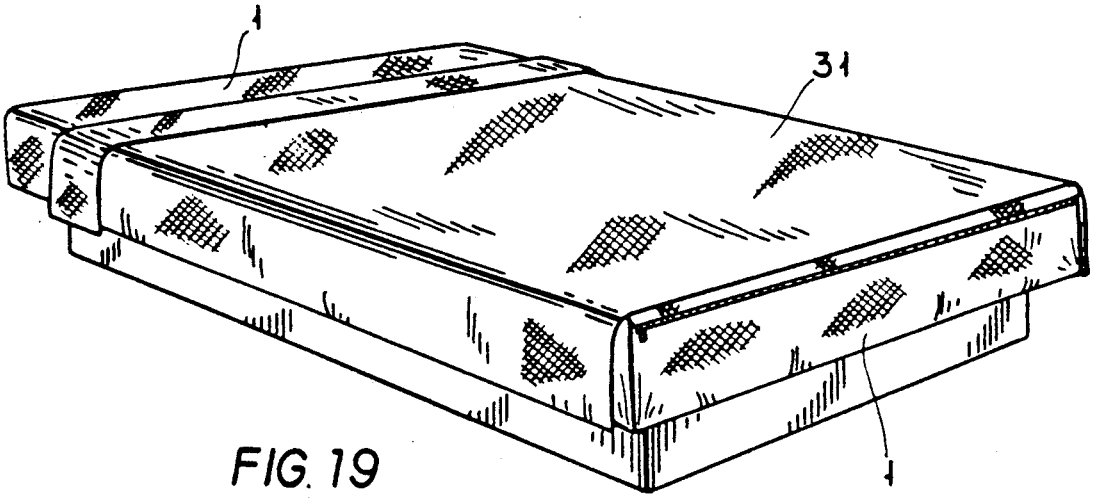
Figure 20:
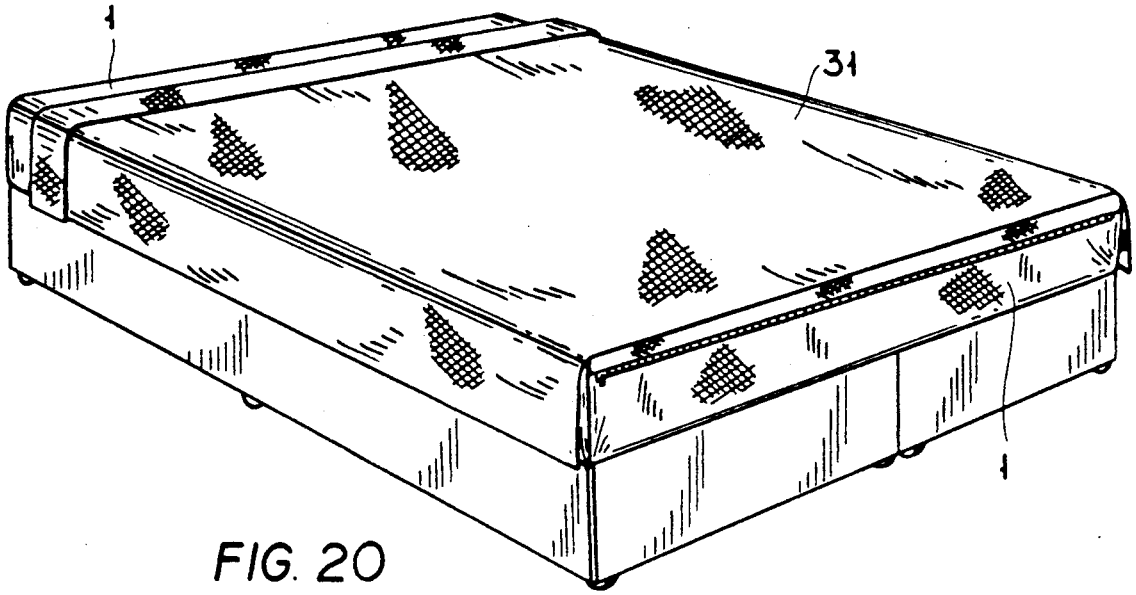
Figure 21:
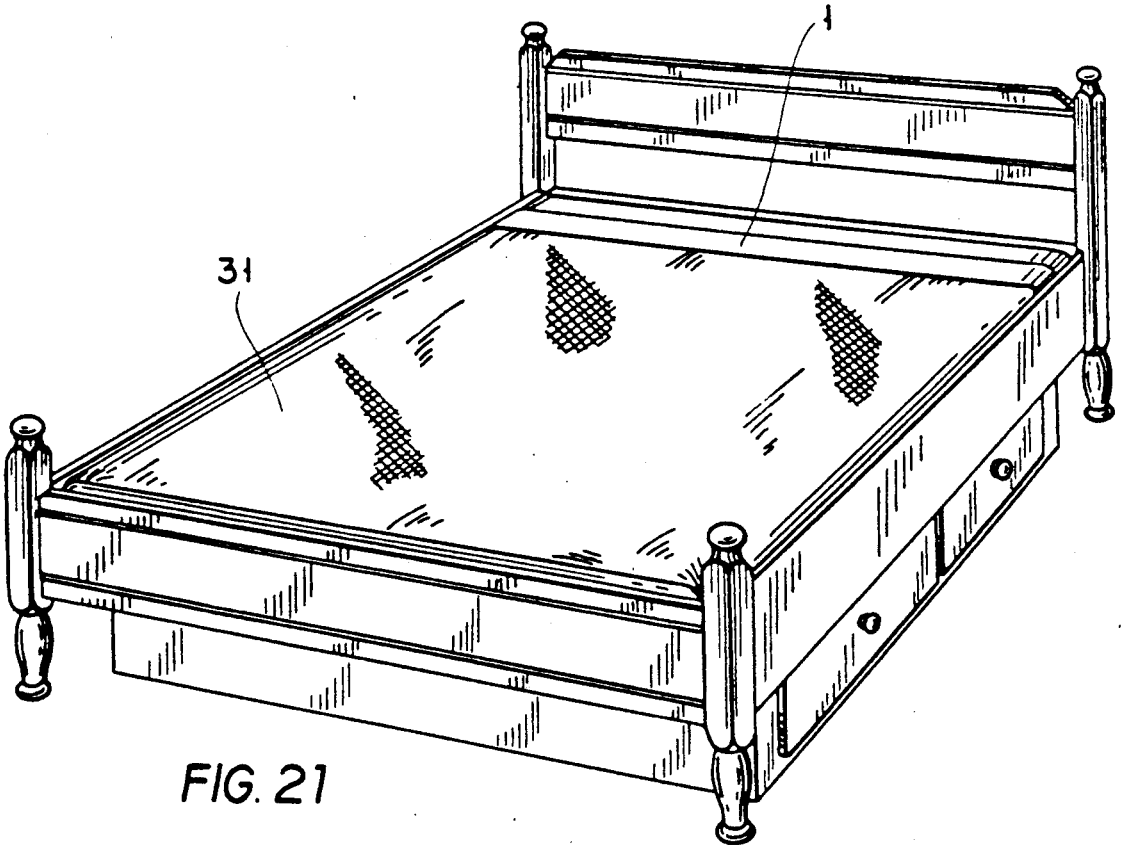

The preferred embodiment of the present invention will now be described with reference to the drawings in which:

FIG. 1 is a perspective view from above of a mattress fitted with the lower sheet of the preferred embodiment, FIG. 2 is an inverted perspective view of the mattress and sheet of FIG. 1, FIGS. 3–11 illustrate a sequence of steps used to fabricate the fitted lower sheet of FIGS. 1 and 2, FIG. 12 is a perspective view similar to FIG. 1 but illustrating how an upper sheet is arranged relative to the lower sheet, FIGS. 13–15 illustrate the sequence of steps required to fabricate the upper sheet of FIG. 12, FIG. 16 illustrates the initial stage of the attachment of the upper and lower sheets of FIG. 12, FIG. 17 illustrates the completed attachment of FIG. 16, FIG. 18 is a view similar to FIG. 12 but illustrating the attachment of a second upper covering, FIG. 19 is a perspective view of a pedestal style soft sided waterbed, FIG. 20 is a perspective view of a soft sided waterbed having a substantially conventional appearance, and FIG. 21 is a perspective view of a hard frame waterbed having a peripheral frame.

Turning now to FIGS. 1 and 2, the fitted lower sheet 1 of the preferred embodiment has a central generally rectangular area 2 having a foot end 3 and a head end 4 which are determined by the intended direction of use of the bed.

Let into the foot end 3 is one part 5 of a first zipper 6 which is illustrated in FIG. 12. It will be appreciated that the first zipper comprises the one part 5 and the other part 7 which preferably contains the slide 8 of the zipper 6.

As seen in FIGS. 1 and 2, the lower sheet 1 has a side wall 10 having a free edge 11 which lies adjacent the underside of the mattress 9. The one part 5 of the first zipper 6 is let into the side wall 10 at the foot end 3 of the lower sheet 1.

Formed around the free edge 11 is a sewn casing 13 which contains a draw string 14 formed from eleastic material. That is to say, the material of the draw string is able to stretched to a length several times its original length and still displays a tendency to return to its original length.

Figure 3:
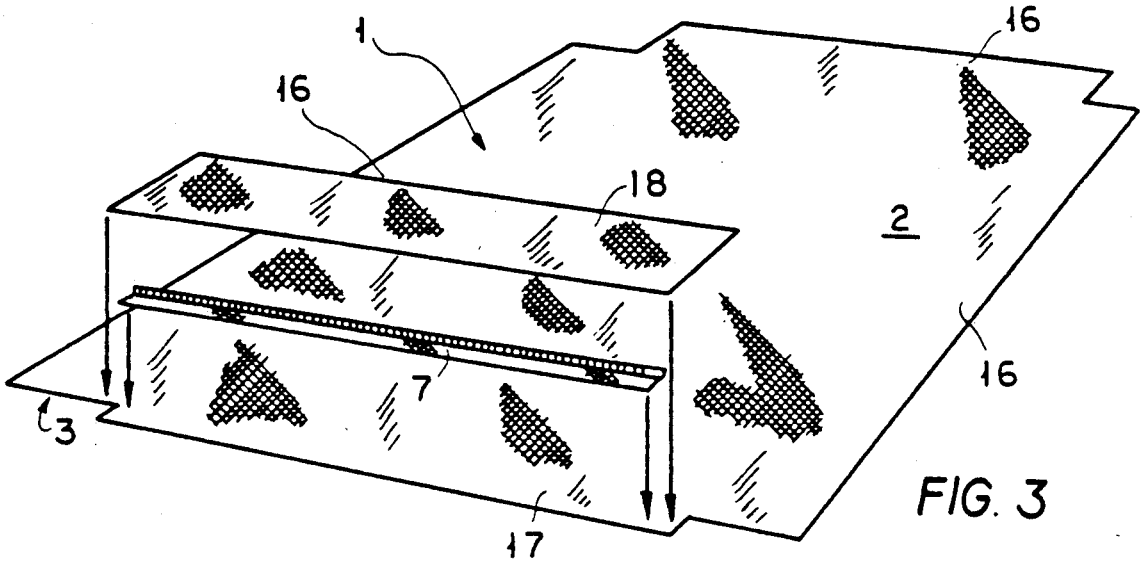

The construction of the lower sheet 1 will now be described with reference to FIGS. 3 to 11 inclusive. As seen in FIG. 3, the lower sheet 1 is cut from a roll of fabric so as to form the central area 2, three side flaps 16 which will ultimately form the side wall 10, and a narrow flap 17 at what will become the foot end 3 of the sheet 1. The one part 5 of the zipper 6 is positioned as illustrated above the narrow flap 17 and above that again is positioned a foot flap 18.

Figure 4:
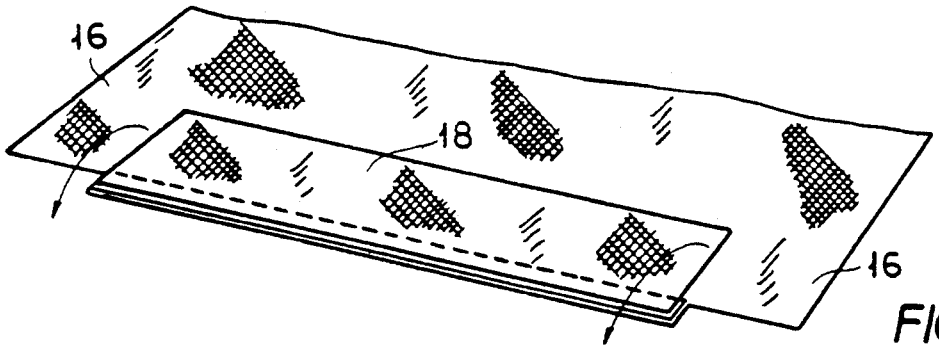
Figure 5:
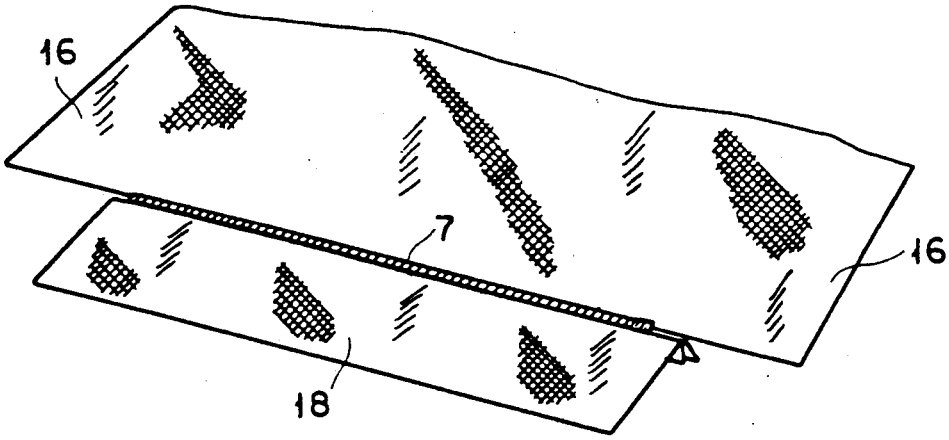

As indicated in FIG. 4 the foot flap 18, one part 5, and narrow flap 17 are sewn together. Then the foot flap 18 is folded over as seen in FIG. 5 so that the sheet 1 is then provided with four flaps which together will constitute the side wall 10.

Figure 6:
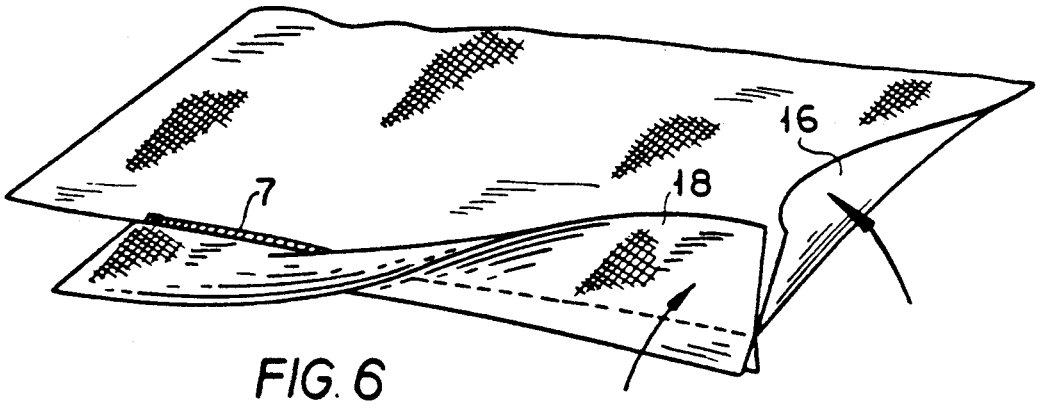
Figure 7:
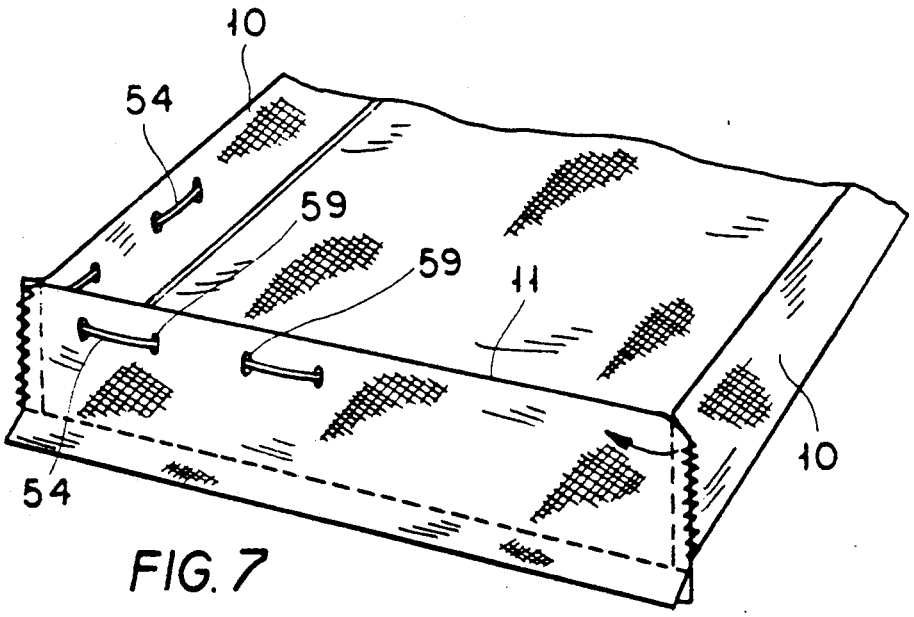
Figure 8:
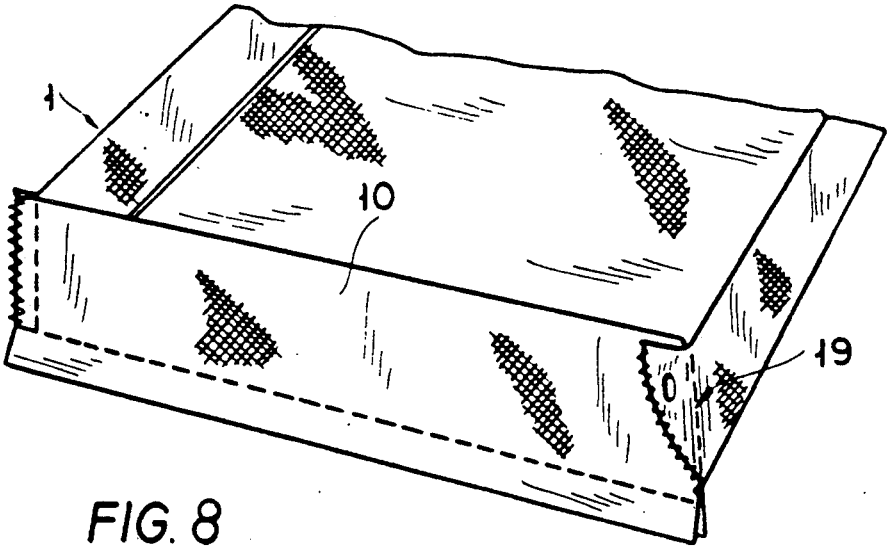

FIGS. 6 to 8 illustrate how the side wall 10 is fabricated by sewing together the adjacent edges of the side flaps 16 and foot flap 18. Somewhere adjacent to the free edge 11, a button hole 19 is formed as illustrated in FIG. 8. Alternative constructions such as unsealed portion of the casing 13 will be apparent to those skilled in the art.

Figure 9:
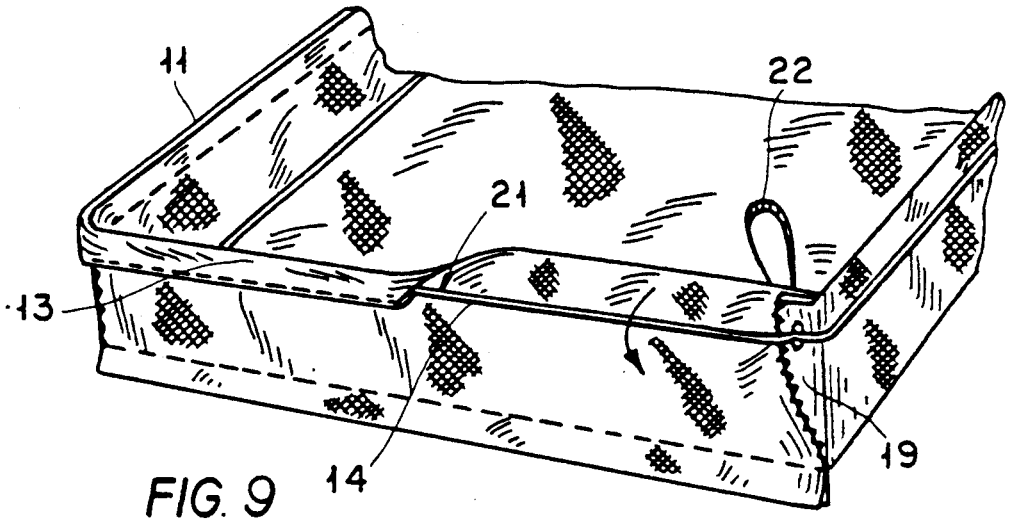

As illustrated in FIG. 9, the free edge 11 is folded over and hemmed so as to form a channel 21 through which the elastic draw string 14 is passed. As indicated in FIGS. 9 and 10, the draw string 14 forms a complete loop of length greater than the free edge 11 and a looped portion 22 of the draw string 14 passes through the button hole 19. It will be appreciated by those skilled in the art that the casing 13 and its channel 21 can be formed and the draw string 14 inserted into it after its formation or, as indicated in the drawings, the draw string 14 can be positioned prior to the sewing of the channel 21.

The final step as illustrated in FIGS. 10 and 11 is to fold down the side walls 10 so as to place the lower sheet 1 nearly into the configuration illustrated in FIGS. 1 and 2. It will be apparent that because of the narow flap 17 the zipper 6 is not located at the upper corner of the mattress 9.

In order to fit the lower sheet 1 to mattress 9, the looped portion 22 is manually extended so as to reduce the length of that portion of the draw string 14 located within the channel 21. Then a knott 23 (FIG. 2) is tied in the looped portion 22 in order to (releasably) fix the length of draw string within the channel 21. Then the fitted lower sheet 1 is placed over the mattress 9 by passing the side wall 10 over the corners of the mattress 9. If the correct length for the draw string 14 within th channel 21 has been selected, the lower sheet 1 has the configuration illustrated in FIGS. 1 and 2. If the correct length has not been selected initially, the knot 23 can be untied, the interior length of the draw string 14 re-adjusted and the knot 23 re-tied. However, after this initial re-adjustment, if necessary, has been completed, the knot 23 remains permantly tied while the mattress is repeatedly used and washed. If, after many months, the draw string 14 should loose its elasticity, the draw string 14 can be quickly and easily replaced and the lower sheet 1 returned to its original condition. This can be done by persons without sewing skills. This is a substantially departure from the prior art.

It will be appreciated by those skilled in the art that the above arrangement which is adjustable, enables a single nominal size, such as a single bed or a double bed sheet, to fit large range of mattresses which have slightly differing dimensions. For example, a range of double bed mattresses may differ by six inches (15cm) in length and/or depth and/or width. In this way a single nominal sheet size is able to be adjusted by the end user to fit the exact size of the user's mattress. This substantially reduces the volume of fitted sheets required to be held in stock by a retailer.

Turning now to FIGS. 12 to 17, an upper sheet 31 will now be described. As seen in FIG. 13, starting with a rectangular portion of fabric, the other part 7 of the first zipper 6 is positioned at the foot end of the upper sheet 31. That end of the sheet 31 is then folded over twice as illustrated in FIG. 14 and secured to the other part 7 so as to locate the other part 7 within a hem 32 formed by the sewing step illustrated in FIG. 14. As indicated by the arrow of FIG. 14, the sheet 31 is then turned over so that the sheet 31 lies in the position illustrated in FIG. 15. Then the hem 32 is folded over and again sewed across the sheet 31 so as to form a double hem 33.

As illustrated in FIGS. 16 and 17, the two parts 5,7 of the zipper 6 can be engaged and the slide 8 moved along the zipper 6 so as to releasably interengage the upper sheet 31 and lower sheet 1 which then lie in the configuration illustrated in FIG. 17.

An important point here is that because of the particular constructional steps taken in the fabrication of the lower sheet 1 and upper sheet 31, the teeth portions of the zipper 6 both face outwardly as seen in FIG. 17, that is to say the teeth are directed away from the space between the upper sheet 31 and lower sheet 1 which is to be occupied by the sleeper. In this way, the smooth interior tape side of the zipper 6 normally used on the inside of the clothes is presented to the sleeper, particularly if the sleeper's feet should extend over the upper edge of the mattress of the foot of the bed. This applies even if the sleeper should be lying on his stomach with his toes extending some distance down the side of the mattress. In this way, the sleeper is entirely unaware by means of touch that there is any fastener present at all at the foot of the bed even if the upper sheet 31 is pushed or folded downwardly at the foot end of the bed.

FIG. 18 illustrates a second embodiment of the present invention in which a second upper covering in the form of a washable quilt cover 41 is provided. The quilt proper (not illustrated) is located within the quilt cover 41 and can be removed therefrom by operation of press-studs 42 or similar releasable fastener. This enables the heavy interior quilt to be removed to permit the quilt cover 41 to be washed at regular intervals. A second zipper 46 having one part 45 fitted to the lower sheet 1 and the other part 47 fitted to the quilt cover 41, is also provided.

It will be clear to those skilled in the art that the quilt cover 41 is fabricated by following the steps illustrated in FIGS. 13 to 15 inclusive and then sewing a further strip of fabric onto the double hem 31 which further strip of fabric forms the lower portion of the opening closed by the press-studs 42. Similarly, it will be clear to those skilled in the art that the sewing steps illustrated in FIGS. 3 to 5 are substantially duplicated in order to produce the lower sheet 1 of FIG. 18. In this connection, the foot flap 18 is provided in two portions 18A and 18B which are sewn together with one part 45 of the zipper 46 positioned between them in the same way that the one part of the zipper 6 is positioned between the flaps 17 and 18 in FIGS. 3-5. Then the completed flap 18A and 18B carrying the one part 45 is substituted for the flap 18 in FIG. 3 and the steps of FIGS. 3 to 5 repeated.

It will be apparent to those skilled in the art that the arrangement illustrated in FIG. 18 enables both the upper sheet and the further upper covering in the form of a quilt cover 41, to be releasably secured to the lower sheet 1 at the foot of the bed. This is of substantial assistance in preventing the upper coverings from being dislodged while sleeping and also enables the bed to be re-made quickly after use.

It will be apparent to those skilled in the art that the quilt cover 41 can also be used alone with the lower sheet 1 of FIG. 16 instead of with the upper sheet 31. This accommodates those persons who wish not to usean upper sheet.

FIGS. 19 to 21 respectively illustrate three forms of water bed on which the lower sheet 1 and upper sheet 31 have been installed. It will be appreciated that the mattress of the water bed is filled with water and is therefore extremely heavy to lift. As a result, coventional upper sheets cannot be tucked in securely. However, the lower sheet 1 to which the upper sheet 31 is secured can be securely located on the water bed mattress notwithstanding the flexure of the side walls of the mattress. Futhermore, those water beds such as that illustrated in FIG. 21 which have a peripheral board are also difficult to make. Because of the elastized draw string 14, one corner of the mattress can be lifted or moved horizontally away from the corner of the frame, the corresponding corner of the lower sheet 1 positioned in place, the corner of the mattress lowered or allowed to "flow" back into its original position, then the next corner of the mattress can be lifted or moved and the corresponding corner of the fitted lower sheet position in place, and so until all four corners of the mattress have been fitted. The tension within the elastizied draw string 14 is normally sufficient to move the lower sheet 1 into its intended final position after the free edge 11 is moved to the lower edge of the mattress or frame. Because of the adjustable draw string 14 the correct tension for each bed can be selected.

The foregoing describes only two embodiments of the present invention and modifications, obvious to those skilled in the art, can be made thereto without departing from the scope of the present invention. For example, rather than provide the sewn channel 21, the side wall 10 of the lower sheet 1 can be hemmed and provided with a series of spaced button holes 59 and an elastized draw string 54 passed in and out of the button holes 59. In addition a blanket can be used instead of the quilt cover 41 as illustrated, the blanket being provided with the zipper part 47 at the hem at its foot end.

What I claim is:

1. A bed sheet arrangement comprising a fitted lower sheet having a substantially rectangular central area having a foot end and a head end with a side wall extending around the central area, that edge of said side wall remote from said central area being provided with a continuous elastically extendable draw string which is constrained to lie alongside the whole length of said side wall edge but to be movable along said side wall edge, and at least a portion of said draw string being manually accessible so that said draw string allows the lower sheet to be releasably attached to a mattress while also being of sufficient length so that movement of the manually accessible portion varies the length of draw string lying alongside the side wall edge to accomodate various sized mattresses.

2. An arrangement as claimed in claim 1 wherein said side wall edge is folded back upon itself and hemmed to form a channel through which said draw string passes.

3. An arrangement as claimed in claim 2 wherein said channel contains an opening through which a loop of said draw string extends to form said manually accessible portion.

4. An arrangement as claimed in claim 3 wherein said opening comprises a button hole.

5. An arrangement as claimed in claim 1 wherein said draw string passes through a series of spaced button holes extending along said side wall edge.

6. An arrangement as claimed in claim 1 and including a substantially rectangular first upper covering having a foot end and a head end and a first two part releasable fastener, one part of said fastener being secured to said side wall of said lower sheet at the foot end thereof and the other part of said fastener being secured at a lower edge to the foot end of said upper covering whereby said upper covering and lower sheet can be releasably joined together at the foot of the bed.

7. An arrangement as claimed in claim 6 wherein said first two part fastener comprises a first zipper having two rows of the inter-engageable teeth.

8. An arrangement as claimed in claim 7 wherein the parts of said first zipper are let into said lower sheet and upper covering respectively with the teeth of said first zipper facing away from the space between said lower sheet and said first upper covering.

9. An arrangement as claimed in claim 6 wherein said first upper covering is selected from the group consisting of an upper sheet and a quilt cover.

10. An arrangement as claimed in claim 6 and including a second two part releasable fastener and a generally rectangular second upper covering having a foot end and head end, one part of said second fastener being secured to the foot end of said second upper covering and the other part of said second fastener being secured to the foot end of said side wall between said first fastener and said side wall edge.

11. An arrangement as claimed in claim 10 wherein said second fastener comprises a second zipper having two rows of inter-engageable teeth and the parts of said second zipper are let into said lower sheet and said second upper covering with the teeth of said second zipper facing away from the space between said lower sheet and said second upper covering.

12. An arrangement as claimed in claim 10 wherein said first upper covering comprises an upper sheet and said second upper covering comprises a quilt cover.

13. An arrangement as claimed in claim 1 wherein said lower sheet is located on a mattress.

14. An arrangement as claimed in claim 13 wherein said mattress comprises a water bed mattress.

15. A bed sheet arrangement comprising:

a fitted lower sheet having a substantially rectangular central area having a foot end and a head end with a side wall extending around the central area, that edge of said side wall remote from said central area is folded back unto itself and hemmed to form a continuous channel around the periphery of the edge of the side wall through which a single continuous elastically extendable draw string passes, and wherein said channel contains an opening through which a loop of said draw strings extends to form a manually accessible portion of said draw string;

a substantially rectangular first upper covering having a foot end and a head end and a first two part releasable fastener, one part of said fastener being secured to said side wall of said lower sheet at the foot and thereof and the other part of said fastener being secured to the foot end of said upper covering whereby said upper covering and lower sheet can be releasably joined together at the foot of the bed; and a second two part releasable fastener and a generally rectangular second upper covering having a foot end and head end, one part of said second fastener being secured to the foot end of said second upper covering and the other part of said second fastener being secured to the foot end of said side wall between said first fastener and said side wall edge, said second fastener including a zipper having two rows of inter-engageable teeth and the parts of said zipper are let into said lower sheet and said second upper covering with the teeth of said zipper facing away from the space between said lower sheet and said second upper covering.

16. A bed sheet arrangement comprising:

a fitted lower sheet having a substantially rectangular central area having a foot end and a head end with a side wall extending around the central area, that edge of said side wall remote from said central area is folded back unto itself and hemmed to form a continuous channel around the periphery of the edge of the side wall through which a single continuous elastically extendable draw string passes, and wherein said channel contains an opening through which a loop of said draw strings extends to form a manually accessible portion of said draw string;

a substantially rectangular first upper covering having a foot end and a head end and a first two releasable fastener, one part of said fastener being secured to said side wall of said lower sheet at the foot end thereof and the other part of said fastener being secured to the foot end of said upper covering whereby said upper covering and lower sheet can be releasably joined together at the foot of the bed; and a second two part releasably fastener and a generally rectangular second upper covering having a foot end and head end, one part of said second fastener being secured to the foot end of said second upper covering and the other part of said fastener being secured to the foot end of said side wall between said first fastener and said side wall edge.

17. The bed sheet arrangement of claim 16, wherein said second fastener comprises a zipper having two rows of inter-engageable teeth and the parts of said zipper are let into said lower sheet and said second upper covering with the teeth of said zipper facing away from the space between said lower sheet and said second upper covering.

18. A bed sheet arrangement comprising a fitted lower sheet having a substantially rectangular central area having a foot end and a head end with a side wall extending around the central area, that edge of said side wall remote from said central area being provided with a continuous elastically extendable draw string which is constrained to lie alongside the whole length of said side wall edge, but to be movable along said side wall edge, at least portion of said draw string being manually accessible, a substantially rectangular first upper covering having a foot end and a head end and a first two part releasable fastener, one part of said fastener being secured to said side wall of said lower sheet at the foot end thereof and the other part of said fastener being secured at a lower edge to the foot end of said upper covering whereby said upper covering and lower sheet can be releasably joined together at the foot of the bed, and a second two part releasable fastener and a generally rectangular second upper covering having a foot end and head end, one part of said second fastener being secured to the foot end of said second upper covering and the other part of said second fastener being secured to the foot end of said side wall between said first fastener and said side wall edge.

19. An arrangement as claimed in claim 18, wherein said side wall edge is folded back upon itself and hemmed to form a channel through which said draw string passes.

20. An arrangement as claimed in claim 19, wherein said channel contains an opening through which a loop of said draw string extends to form said manually accessible portion.

21. An arrangment as claimed in claim 20, wherein said opening comprises a button hole.

22. An arrangement as claimed in claim 18, wherein said draw string passes through a series of spaced button holed extending along said side wall edge.

23. An arrangement as claimed in claim 18, wherein said first two part fastener comprises a first zipper having two rows of inter-engageable teeth.

24. An arrangement as claimed in claim 23, wherein the parts of said first zipper are let into said lower sheet and upper covering respectively with the teeth of said first zipper facing away from the space between said lower sheet and said first upper covering.

25. An arrangement as claimed in claim 18, wherein said first upper covering is selected from the group consisting of an upper sheet and a quilt cover.

26. An arrangement as claimed in claim 18, wherein said second fastener comprises a second zipper having two rows of inter-engageable teeth and the parts of said second zipper are let into said lower sheet and said second upper covering with the teeth of said zipper facing away from the space between said lower sheet and said second upper covering.

27. An arrangement as claimed in cliam 18, wherein said first covering comprises an upper sheet and said second upper covering is selected from the group consisting of a quilt cover and a blanket.

28. An arrangement as claimed in claim 18, wherein said lower sheet is located on a mattress.

29. An arrangement as claimed in claim 28, wherein said mattress comprises a water bed mattress.

* * * * *